US007742730B2

(12) United States Patent
Roof

(10) Patent No.: US 7,742,730 B2
(45) Date of Patent: Jun. 22, 2010

(54) CONTROL TO DETECT AIR KNIFE BLOCKAGE

(75) Inventor: Bryan J. Roof, Newark, NY (US)

(73) Assignee: Xerox Corporation, Norwalk, CT (US)

( * ) Notice: Subject to any disclaimer, the term of this patent is extended or adjusted under 35 U.S.C. 154(b) by 451 days.

(21) Appl. No.: 11/925,021

(22) Filed: Oct. 26, 2007

(65) Prior Publication Data

US 2009/0110415 A1 Apr. 30, 2009

(51) Int. Cl.
*G03G 15/20* (2006.01)

(52) U.S. Cl. ..... 399/323; 271/309

(58) Field of Classification Search ..... 399/323; 271/309

See application file for complete search history.

(56) References Cited

U.S. PATENT DOCUMENTS 6,243,556 B1 * 6/2001 Shin ..... 399/323
7,505,723 B2 * 3/2009 Roof ..... 399/323
2004/0120735 A1 * 6/2004 Baba et al. ..... 399/323

* cited by examiner

*Primary Examiner*—David M Gray
*Assistant Examiner*—Barnabas T Fekete
(74) *Attorney, Agent, or Firm*—Fay Sharpe LLP

(57) ABSTRACT

A system for detecting stripper device blockage in a printing system is disclosed. The system includes a fusing member which during operation contacts a sheet of printer media to fuse a marking material to the sheet, a stripping device configured to apply pressurized air from an air supply through at least one orifice to the fuser member in order to separate the sheet from the surface and a flow measurement device in line with the air supply which measures air flow. The air flow device will assist in performing an assessment check which may include taking a baseline measurement of air flow and a diagnostic measurement of air flow. In the case where the difference between the diagnostic measurement and baseline measurement is above a different threshold, corrective action may be taken.

20 Claims, 2 Drawing Sheets

CONTROL TO DETECT AIR KNIFE BLOCKAGE

BACKGROUND

The exemplary embodiment relates to the imaging arts. It finds particular application and connection with air knife stripping systems for fuser assemblies and will be described with specific reference thereto.

In typical electrostatographic printing systems, for example, such as copy machines and laser beam printers, a marking engine includes a photoconductive insulating member, such as a photoreceptor belt or drum, which is charged to a uniform potential and therefore exposed to light image of an original document to be reproduced. The exposure discharges the photoconductive insulating surface in exposed or background areas and creates an electrostatic latent image on the member, which corresponds to the image areas contained within the document which is to be reproduced. Therefore, the electrostatic latent image on the photoreceptive insulating surface is made visible by developing the image with a marking material. Generally, the marking material comprises toner particles adhering triboelectrically to carrier granules, which is often referred to simply as toner. The image signals are stored and are read out successfully to a marking engine for formation of images and transfer of the images to a print medium, such as, sheets of paper.

In order to provide a high quality of service, it is useful to provide an easy releasing surface for treatment of the fuser roll. Untreated, the toner has a tendency to stick to the elastomeric surface of the heated fuser member. This problem is very common in the cases of members which are made of materials with relatively high surface energies as compared to materials such as Teflon. In these instances, release fluids are often employed to effectively reduce the surface energy of the roll and aid in the release of the toner. Even with the addition of release fluids and or low surface energy materials, it is often desirable to physically strip the printing media sheets from the fused surface of the roll. There are a variety of stripping solutions that are known in the art. However, it is desirable to have a method of stripping which is non-contact. Contact methods, such as stripping fingers, often cause premature wear which eventually results in the costly replacements of fusing members. One common method of non-contact stripping is the use of air knives.

In air knife stripping, jets of air are directed towards the print media to separate the print media from the fusing surface. The jets are emitted from small holes, or orifices, in an elongate surface which extends adjacent to the fuser roll. This method places an extrusion, having orifices directed towards the rolls in close proximity to the fuser nip. When the air knife's plenum is pressurized at a pressure higher than ambient air, the air is forced through the orifices and the jets of air impinge on fuse member surface. As the leading edge of the paper to be stripped approaches the impinging jet, lift and drag forces cause the paper to peel from the surface of the fuse member. The air jets have a tendency to lower the surface temperature of the fuse roll adjacent the jet through forced convection. This results in uneven gloss across the print media. For this reason it is found to be useful to apply a short burst of air, just as the leading edge of the print media reaches the air knife. The use of the short burst of air minimizes cooling, therefore, increasing the quality of the printing job.

The mass flow rate emanating from the jets is an important parameter to stripping performance. Air pressure can be a major factor in determining the flow rate, however, a reading of air pressure cannot detect orifice blockage. As a fusing air knife ages, orifices can become clogged by molten toner or other obstructions. As the orifices become clogged, the flow from that orifice reduces, resulting in a poor stripping performance.

If the air knife system develops blockage from molten toner or other objects, a service call is often required to diagnose the problem. There is a need in the industry to correct this problem to allow for a method of diagnosing orifice blockage without requiring a service call.

INCORPORATION BY REFERENCE

The following references, the disclosures of which are incorporated by reference herein in their entireties, are mentioned.

U.S. Pat. No. 3,981,085, issued Sep. 21, 1976, entitled AIR STRIPPING DEVICE FOR ELASTOMERIC SURFACE, by Franko, discloses an air stripping device for stripping copy sheets from the surface of an elastomeric fuser roll surface in which copies are fused under heat and pressure. The air stripping device utilizes the deformation in the elastomeric surface resulting from the pressure to strip the copy sheets without directly contacting the fuser roll surface. One or more apertures are formed in the tip portion of the stripping device which are connected to a source of air pressure. The tip portion can be either flat or curved and is positioned at an acute angle relative to a tangential direction from which the copy sheet is stripped from the fuser roll surface.

U.S. Pat. No. 6,490,428, issued Dec. 3, 2002, entitled STRIPPER FINGERS AND ASSOCIATED MOUNTS FOR A FUSER IN A PRINTING APPARATUS, by Fromm, et al., discloses a fuser for xerographic printing in which stripper fingers remove the print sheet from a fuser roll. Each stripper finger is a thin member which is urged against the fuser roll with a spring force caused by deformation of the stripper finger against the roll.

U.S. Pat. No. 5,406,363, issued Apr. 11, 1995, entitled PREDICTIVE FUSER MISS-STRIP AVOIDANCE SYSTEM AND METHOD, by Siegel, et al. discloses an apparatus for minimizing fuser miss-strips from a heat and pressure fuser in an electrophotographic printing machine. A plurality of sensors are provided to determine the basis weight of the copy sheet, the density of the image being transferred to the copy sheet and fused thereon, the relative humidity of the machine environment, the process speed of the print engine, and the like. One action that may be taken to prevent a miss-strip is to increase the amount of release agent that is distributed to the fuser roll. Additionally, an air jet can be actuated to cause a jet of air to lift the leading edge of the fused sheet from the fuser roll, thus preventing a miss-strip.

U.S. patent application Ser. No. 11/705,853, filed Feb. 13, 2007, entitled AIR KNIFE SYSTEM WITH PRESSURE SENSOR, by Roof, discloses an air knife stripping system for a fuser assembly.

BRIEF DESCRIPTION

In accordance with one aspect of the disclosure, a system for detecting stripper device blockage in a printing system includes a fuser member which, during operation, contacts a sheet of print media to fuse a marking material to the sheet. A stripping device configured to apply pressurized air from an air supply through at least one orifice to the fuser member in order to separate the sheet from the surface of the fuser member and a flow measurement device in line with the air supply which measures the air flow. The flow measurement device may be a hot wire anemometer and the stripping device may be an air knife. The system may also include a pressure sensor which measures the pressure of the pressurized air in a fluid gateway connecting the air supply and the orifices adjacent the fuse member. This pressure sensor is useful for detecting leakage.

In another aspect, a method for detecting blockage in a system designed from removing paper from a fuse member includes setting a different threshold, performing an assessment check including taking a base line measurement of air flow and recording the base line measurement in a memory, taking a diagnostic measurement of the air flow with a flow measurement device, and if the difference between the diagnostic measurement and the base line measurement is above the difference threshold, taking corrective action. The corrective action may include increasing the air flow, setting off an alarm and/or a purging routine.

In another aspect of the present disclosure, a fusing assembly comprising a fuser and a stripping apparatus where the stripping apparatus comprises a pneumatic airflow system configured to deliver a pulse of air during operation and a steady flow of air during a diagnostic routine, an air flow sensor in communication with the air flow system configured to measure the air flow during the diagnostic routine and a control system which receives signals from the air flow sensor and is configured to actuate a corrective action when the diagnostic routine does not meet a predetermined threshold standard.

DETAILED DESCRIPTION

Aspects of the exemplary embodiment relate to a stripping apparatus for stripping sheets from a fuser member, such as a heated roll of a fuser, to a fusing assembly, incorporating the stripping apparatus, and to a method of printing.

The exemplary stripping apparatus includes an air knife and a pneumatic airflow system which supplies the air knife with pressurized air, or other suitable gas or gas mixture. It has been found that in a conventional air knife system, the air flow can vary over time, due, for example, to leaks, blockages, or the likes in the pneumatic system. As a consequence, the airflow at the jets may diminish, leading to unsuitable performance of stripping the paper from the fuser roll. This can lead to image quality issues and/or paper jams.

However, another factor in the quality of stripping is the wear on the fuser. If the fuser roll is considerably worn, increasing the airflow may not cure the problem, and in some cases, may exacerbate the problem. If the airflow is too high, differential gloss problems may occur due to cooling of the fuser. Therefore, through this exemplary embodiment of the disclosure, the air flow is measured in order to detect blockage which may occur in the air knife. Based on the sensed air flow, a control system may implement a procedure to allow for corrective action to take place, such as a request for a service call or adjustment to the airflow system.

A "printing system," as used herein, may include any device for rendering an image on print media. These devices include, but are not limited to, a copier, printer, a bookmaking machine, a facsimile machine, and/or a multifunction machine. In general, a printing system may include at least one marking engine which includes components for rendering an image on print media and fusing assembly for fixing the image to the print media. Marking engines include xerographic marking engines, although inkjet marking engines are also contemplated, such as those which employ heat-curable inks or "solid" inks, which are heated into a liquid state prior to marking and which solidify again upon cooling.

"Print media" can be a flimsy physical sheet of paper, plastic, or other suitable physical print media substrate on which images may be printed. An image may generally may include information in electronic form which is to be rendered on the print media by the printing system. Image may include things such as text, graphics, pictures, etc. The operation of applying images to print media, for example, graphics, text, photographs, etc., is generally referred to herein as "printing".

Figure 1:
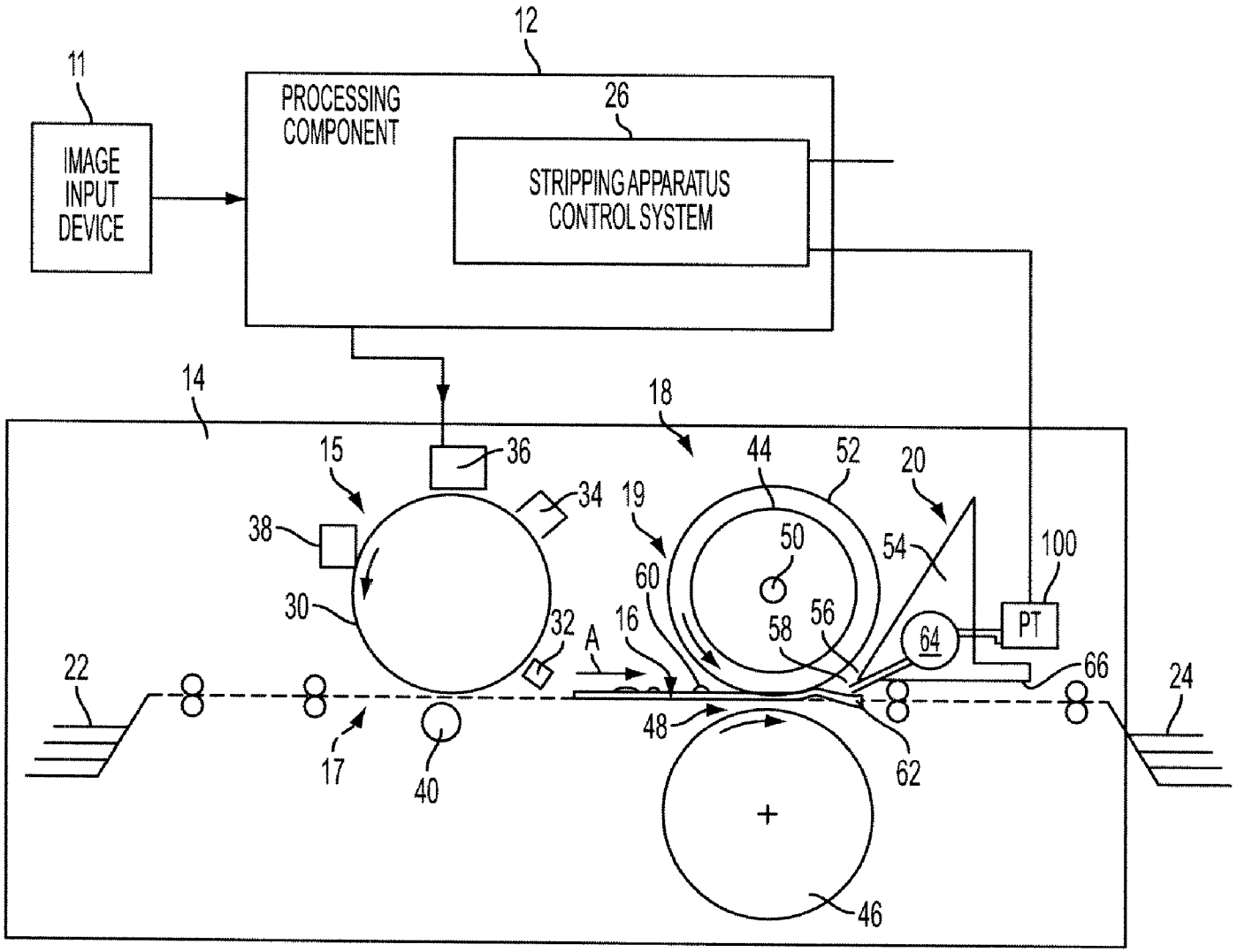
FIG. 1 is a schematic elevation view of a printing system comprising a stripping apparatus in accordance with one aspect of the present disclosure.

Now referring to FIG. 1, which is a schematic elevation view of electrophotographic (e.g. xerographic) printer. This printer incorporates an exemplary stripping apparatus 20. It will be appreciated that the stripping apparatus is equally well suited for a variety of printers, and is not limited in its application to the particular system shown herein. A document to be printed, such as an electronic document or a scanned hard copy, is transmitted as electrical signals from an image input device 11, such as a scanner, computer, or the like to a processing component 12 of the printing system (e.g., a digital front end). The processing component converts the digital image into a form in which it can be rendered by a marking engine 14. The marking engine 14 includes an image applying component 15, which applies a toner image to the sheet of print media 16 conveyed by a conveyor system 17 on the print media path. The print media 16, in this embodiment, travels in the general direction of arrow A. The marked print media 16, with a toner image thereon, is conveyed to a fuser assembly 18. The fuser assembly includes a fuser 19, which applies heat and pressure to fix the toner image more permanently to the sheet, and a stripping apparatus 20 which assists in removing the fused sheets from the fuser 19.

In one embodiment, the printer media to be marked is fed from a feeder 22, upstream of the marking engine and the marked sheets are delivered by the conveyor system 17 to a finisher 24, downstream of the fuser 19. The stripping apparatus 20, and optionally other components of the printing system, including the image applying component 15, fuser 19, and conveyor system 17, may be under the control of a control system 26, which controls the operation of printing. It will be appreciated that FIG. 1 is a simplified representation of a printer and that additional components, such as inverters, additional marking engines, decurlers, and the like may be incorporated into the print media path.

An image applying component 15 may include a variety of subcomponents employed in the creation of desired images by electrographic processes. In the case of the xerographic device, the image applying component of the marking engine typically includes a charge retentive surface, such as a rotating photoreceptor 30 in the form of a belt or drum. The images are created on a surface of the photoreceptor. Disposed at various points around the circumference of the photoreceptor 30 are xerographic subsystems which include a cleaning device generally indicated as 32, a charging station for each of the colors to be applied (one in the case of a monochrome printer, four in the case of a CMYK printer), such as a charging corotron 34, an exposure station 36, which forms a latent image on the photoreceptor, such as a raster output scanner, a developer unit 38, associated with each charging station for developing the latent image formed on the surface of the photoreceptor by applying a toner to obtain a toner image, and transferring unit 40, such as a transfer corotron which transfers the toner image thus formed to the surface of a sheet of print media 16.

The fuser 19 receives the marked print media with the toner thereon and applies heat and pressure to fuse the image to the sheet of print media 16. The illustrated fuser 19 includes a pair of rotating rolls 44, 46, which together define a nip 48 through which the sheet with the toner image thereon passes. At least one of the rolls 44 is heated, for example, by means of an internal heater 50, such as a lamp. The other roll 46 applies pressure at the nip 48 and in one embodiment, may also be heated. The fuser roll 44 has an elastomeric surface 52 to which a thin coating of release oil, such as silicone oil, may be applied. The surface 52 may be provided by a layer of Teflon™ or similar material, which is supported on a cylindrical metal core. While particular reference is made to a rotating fuser roll, other fuser members, such as belts, are also contemplated.

The exemplary stripping apparatus 20 includes an air knife 54 which is positioned downstream of the nip 48. A stripping edge 56 of the air knife 54 is positioned closely adjacent to, but without touching, the fuser surface 52. Spaced along the edge (e.g., in the cross-process direction) are a plurality of orifices 58 which direct air jets toward the toner side 60 of the leading edge 62 of the print media 16 to detach the leading edge of the print media 16 from the fuser roll 44. The orifices 58 are fed with air from a plenum 64 within the air knife 54. An underside 66 of the air knife 54 may provide a guiding surface for the sheet.

Figure 2:
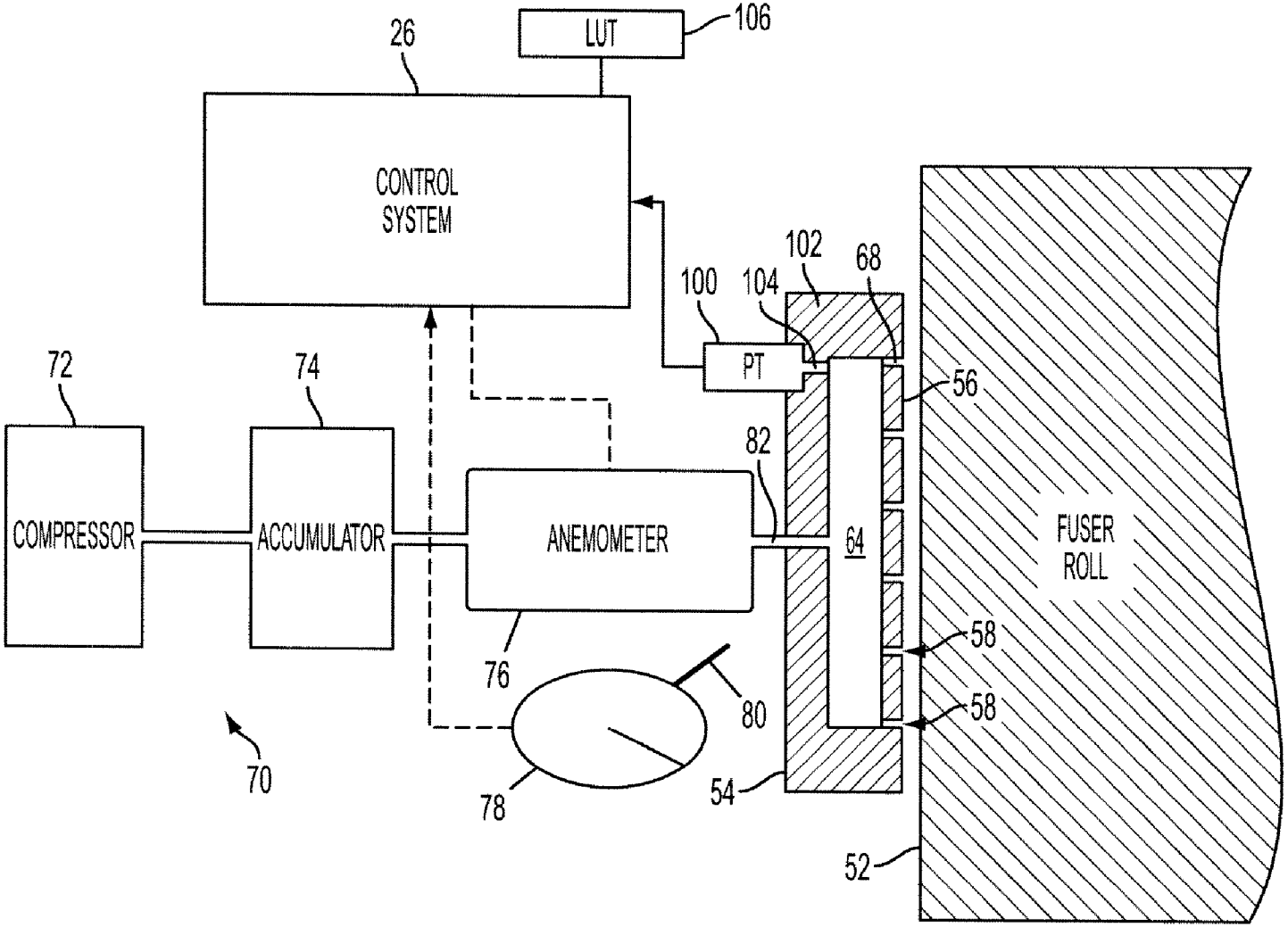
FIG. 2 is a plane view of a fusing assembly comprising a first embodiment of the stripping apparatus of FIG. 1.

Now referring to FIG. 2, which is a plane view of the fusing assembly comprising a first embodiment of the stripping apparatus of FIG. 1. FIG. 2 shows the plenum 64 has its longest dimension arranged in the cross-process direction with the orifices 58 communicating with the plenum via individual air supply tubes 68 formed in a wall of the air knife 54 which defines the edge 56. While multiple collinear orifices 58 feeding air in generally the same orientation from the plenum 64 are shown, it is also contemplated that other arrangements of orifices 58 may be provided. These other arrangements include a single laterally extending orifice which may implemented and will still be within the spirit of this disclosure.

The pneumatic system 70 supplies air which has a positive air flow to the plenum 66. In one embodiment, the pneumatic system includes a source 72 of pressurized air, such as a compressor. The pressurized air may be stored temporarily in an accumulator 74 in communication with the compressor 72. The plenum 64 forms a part of a fluid pathway 82, which carries air from the accumulator to the air knife orifices 58. The fluid pathway 82, in this embodiment includes a anemometer 76 which is in line with the air fluid pathway 82 and measures the air flow. This embodiment also includes a pressure tap 78 which includes a pressure sensor 80, which is configured to sense the pressure of the gas in the fluid path way 82. The pressure tap 78 and anemometer 76 work in conjunction to communicate with the control system 26 in order to detect when corrective action may need to be taken.

In this embodiment shown in FIG. 2, an anemometer 76 is used as the device which takes the flow measurement. However, it should be appreciated that flow may be measured in a variety of different ways. Other methods includes a vein system, hot wire system and/or a strain gauge type. However, in this embodiment the hot wire anemometer 76 which is a well known thermal anemometer may measure the fluid velocity by noting the heat convected away by the fluid. The anemometer 76 measures the change in wire temperature under constant current by use of the convective theory.

In one embodiment, the pressure sensor 80 may be a fast response pressure sensor such as a pressure transducer. In order to detect changes in pressure during the course of the pressure cycle, the pressure transducer 80 may have a response time that is relatively short (e.g. 20 miliseconds). Another exemplary embodiment, the pressure transducer 80 is a capacitative transducer, such as a SENSATA 61 CP series or 67 CP series ceramic capacitative pressure sensor which has a maximum response time of 10 miliseconds.

In operation, a different threshold may be set where the different threshold dictates the tolerance of a trigger for an alarm system. The difference threshold may be a minimum flow measurement or a difference between the base line flow measurement and diagnostic measurement. This threshold may also vary based on the age of the printing system, air knife and/or flow measurement device. The difference threshold may also be set by manufacturer, owner, or programmed by a user.

In one embodiment, an assessment check is done by taking a baseline measurement of the air flow and recording the baseline measurement in a memory. This may be done at a factory where the printing system is assembled. Generally, a constant pressure will be applied to the air knife 54 in order to collect the baseline reading. Generally, stripping pulses cycles occur in the order of milliseconds. As explained above, this is to maintain the heat in the fuser roll. Many flow measurement devices are inadequate for measuring real time flow changes that may occur this quickly. In some embodiments, when the flow measurement device is inadequate for measuring real time flow changes, air is applied at a constant pressure in order to get a steady state reading. This method is useful when the flow measurement device 76 is anemometer.

Periodically, the printing system may apply air at the same pressure that was used while taking the baseline reading. Generally, this air will be held long enough to get a steady state reading once again by the flow measurement device 76. In one embodiment, this reading is taken while the printing system is warming up. In another embodiment, this reading may be taken before the printing system shuts down. This diagnostic reading may also be taken on demand or immediately before or after a service call. The reading may then be sent from the flow measurement device 76 to a control system 26 where the baseline reading was stored.

These readings may then be compared to each other. If the difference between the diagnostic measurement and the baseline measurement is above the difference threshold, directive action may then be taken. Generally, if the diagnostic value is within an acceptable level, e.g. below the difference threshold, then no action would be taken. This diagnostic value will indicate if there is low air flow generally due to clogging of one or more orifices 58.

Corrective action may include a variety of different procedures. One such corrective action may include triggering an alarm. The alarm could indicate that service is needed or that one other piece of corrective action should be implemented. Another form of correction action includes a purge routine. The purge routine may include discharging a blast of high pressure air through the stripping device. This may be used as an attempt to unclog any orifices that may have toner or oil stuck therein, causing a decrease in flow.

Another form of correction action may include utilizing an actuated regulator that can be adjusted to increase flow rates and thereby compensate for the deficiency until a service action can be done at a more convenient time. This action may include actuating the regulator to increase flow and matching the present flow to a stored value. The stored value may be met by matching the anemometer values. The action may also include measuring the pressure from the transducer and storing the new pressure at a set point. In any event, the correction action may lower service calls and increase customer satisfaction. In this form, a service call may not be needed if the clog was cleared due to one of the corrective actions. Furthermore, each service call may not be an emergency, giving leeway due to early detection. Furthermore, regular service calls may be monitored and appropriately scheduled, thereby creating a more efficient service routine.

While the printing system has been described with respect to a single control system 26, it is to be appreciated that the control system 26 may include a plurality of control systems where control is regulated through separate aspects of the printing system. Furthermore, the control system may not be in one location but may be distributed throughout the printing system, or in operative communication therewith, thereby the aspects of the control system may be compiled in a variety of hardware and software configurations.

The exemplary control system 26 may execute instructions stored in associated memory for performing the methods described therein and may be implemented as a general purpose computer, dedicated computering device, or the like.

It will be appreciated that various parts of the above-disclosed description and other features and functions, or alternatives thereof, may be desirably combined into many other different systems and/or applications. Also, various presently unforeseen or unanticipated alternatives, modifications, variations or improvements therein may be subsequently made by those skilled in the art. In such a case, the alternative modification, variations and improvements are intended to be encompassed by the following claims.

The invention claimed is:

1. A system for detecting stripper device blockage in a printing system comprising:

a fuser member which, during operation, contacts a sheet of print media to fuse a marking material to said sheet;

a stripping device configured to apply pressurized air from an air supply through at least one orifice to said fuser member in order to separate said sheet from the surface of said fuser member; and a flow measurement device in line with said air supply which measures the air flow.

2. The system according to claim 1, wherein said flow measurement device is thermal anemometer.

3. The system according to claim 2, wherein said thermal anemometer is a hot-wire anemometer.

4. The system according to claim 1, wherein said flow measurement device is a vane system.

5. The system according to claim 1, wherein said stripping device is an air knife.

6. The system according to claim 1, further comprising a pressure sensor configured to sense pressure of said pressurized air in a fluid gateway connecting said air supply and said at least one orifice adjacent to said fuser member.

7. The system according to claim 6, wherein said pressure sensor is a pressure transducer.

8. The system according to claim 1, further comprising a controller configured to store a base-line air flow reading and compare said base-line flow reading to a diagnostic reading form said flow measurement device producing a calculated flow difference.

9. The system according to claim 8, further comprising an alarm including a trigger, where said trigger is engaged when said calculated flow difference surpasses a predetermined flow threshold.

10. The system according to claim 9 further comprising an actuated regulator configured to increase the flow in order to compensate, at least in part, for the calculated flow difference.

11. A method for detecting blockage in system designed for removing paper from a fuse member comprising:

setting a difference threshold;

performing an assessment check, including taking a base line measurement of air flow, and recording said base line measurement in a memory;

taking a diagnostic measurement of the air flow with a flow measurement device; and if the difference between the diagnostic measurement the baseline measurement is above the difference threshold taking corrective action.

12. The method according to claim 11, wherein said corrective action includes triggering an alarm.

13. The method according to claim 11, wherein said corrective action includes increasing the air flow via an actuated regulator.

14. The method according to claim 11, wherein said corrective action includes implementing a purge routine.

15. The method according to claim 11, wherein said flow measuring device is an anemometer.

16. The method according to claim 11, further comprising sensing the pressure of the air being applied toward said fuser member.

17. The method according to claim 11, wherein said assessment check and said diagnostic check include measuring the airflow at steady state.

18. The method according to claim 11, wherein said flow measuring device is a thermal anemometer.

19. The method according to claim 11, wherein said diagnostic measurement is taken during the warm-up of said printing device.

20. A fusing assembly comprising a fuser and a stripping apparatus, the stripping apparatus comprising:

a pneumatic airflow system configured to deliver a pulse of air during operation and a steady flow of air during a diagnostic routine;

an airflow measurement device in communication with said airflow system configured to measure the airflow during said diagnostic routine; and a control system which receives signals from said airflow sensor and is configured to actuate an corrective action when the diagnostic routine does not meet a predetermined threshold.

* * * * *